United States Patent [19]

Kessler

[11] 4,057,175

[45] Nov. 8, 1977

[54] SERVING CONTAINER FOR LIQUIDS OR POURABLE MATERIALS CONTAINED IN CARDBOARD PACKAGES

[76] Inventor: Hans Kessler, Dufourstrasse 48, Zurich, Switzerland, CH8008

[21] Appl. No.: 665,802

[22] Filed: Mar. 11, 1976

[30] Foreign Application Priority Data

Mar. 13, 1975 Switzerland ..... 3183/75

[51] Int. Cl.[2] ..... B67B 7/24

[52] U.S. Cl. ..... 222/86

[58] Field of Search ..... 222/83.5, 86, 88, 85, 222/183

[56] References Cited

U.S. PATENT DOCUMENTS

| | | | |
|---|---|---|---|
| 1,920,385 | 8/1933 | Hamilton | 222/83.5 |
| 2,053,370 | 9/1936 | Kann | 222/83.5 |
| 2,499,259 | 2/1950 | Prickett | 222/86 X |
| 2,558,575 | 6/1951 | Massari | 222/86 |
| 2,589,890 | 3/1952 | Stoecker | 222/86 |
| 2,676,732 | 4/1954 | Greenwood | 222/86 |
| 3,285,472 | 11/1966 | Olson | 222/86 |

*Primary Examiner*—Stanley H. Tollberg
*Assistant Examiner*—Hadd Lane
*Attorney, Agent, or Firm*—Kenneth S. Goldfarb

[57] ABSTRACT

A serving container for liquids or pourable materials contained in cardboard packages comprising a base portion and a sleeve inserted into the base portion and fitted over the package. The sleeve is provided with a lid having tubes of differing diameters extending into the interior of the container for pouring from the container and for venting the container. The sleeve has dimensions smaller than the package for exerting exterior local pressure on the package.

7 Claims, 6 Drawing Figures

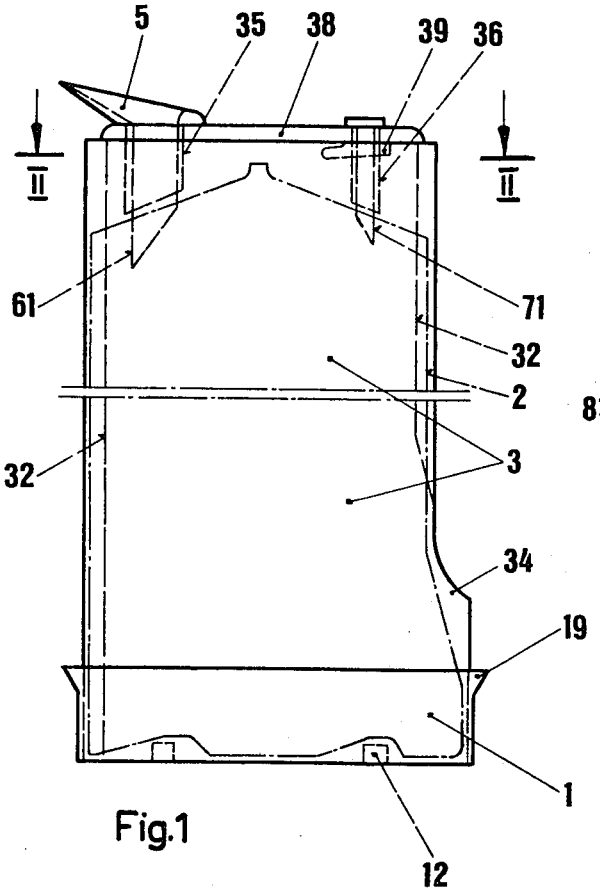
Fig.1
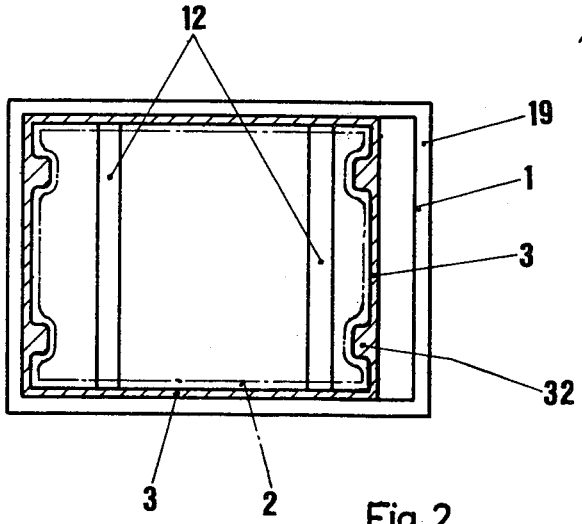
Fig.2
Fig.3
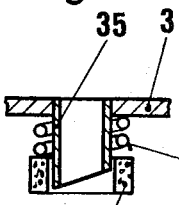
Fig. 4
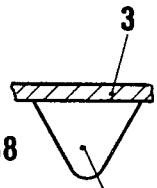
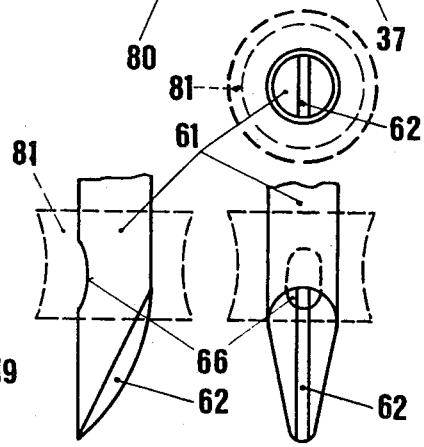
Fig.5
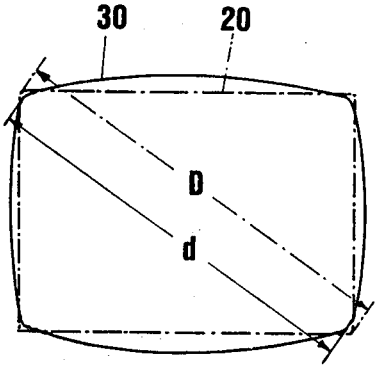
Fig.6

SERVING CONTAINER FOR LIQUIDS OR POURABLE MATERIALS CONTAINED IN CARDBOARD PACKAGES

The present invention relates to a serving container for liquids or pourable materials contained in cardboard packages, the containers comprising a base portion and a sleeve inserted into the base portion and fitted over the package, the sleeve having a lid provided with two tubular members of different diameters which are intended to push into the package, which have inclined tips extending towards the interior of the container and which serve as pouring and ventilation tubes, respectively.

Such containers are known. When they are in use, in particular when the pouring and ventilation tubes are pushed into packages made of strong cardboard or plastics material, difficulties arise in that the liquid spurts outwardly adjacent the tubes and through the tubes.

It is an object of the present invention to reduce or even entirely eliminate the spurting of the liquid and to enable the liquid to be poured out without loss.

According to the present invention, in a container of the above-mentioned type, the sleeve and/or the base part has means for exerting on the inserted package an exterior, local, pressure.

In this way, before the insertion of the pouring and ventilation tubes, the package is placed under a pressure or preloading, whereby the insertion of the tubes is facilitated and the undesired leakage of liquid is avoided.

The invention will be more readily understood from the following description of an embodiment thereof given, by way of example, with reference to the accompanying drawings, in which:

FIG. 1 shows a side view of a container for cardboard packages;

FIG. 2 shows a view taken in section along the line II—II of FIG. 1;

FIGS. 3 and 4 show views taken in section through a modification of parts of the sleeve lid;

FIG. 5 shows on a larger scale and in three views the tip of the pouring tube; and FIG. 6 shows a diagramatic view taken in cross-section through a further embodiment of the service container.

The container shown in FIGS. 1 to 3 comprises a base part 1 and a sleeve 3 inserted into the base part 1, which sleeve 3 is fitted over a liquid package 2. Ribs 12 are arranged on the bottom of the base part 1, and two longitudinal ribs 32 are provided on each of two opposed sidewalls of the sleeve 3. The lid of the sleeve 3 is provided with additions in the form of two tube portions 35 and 36 or a plurality of noses 37 projecting towards the interior of the sleeve. The ribs 13 and 32, the tube portions 35 and 36 and the noses 37 are dimensioned so that the enclosed package is subjected to an exterior pressure, i.e. it is somewhat compressed at the positions at which it abuts these parts.

In the embodiment illustrated in FIG. 1, the tubular portions 35 and 36 are parts of a slide 38. Openings corresponding to these tubular parts are provided in the lid. The slide is retained in the lid by means of a block 39 engaging behind the lid.

In FIG. 3, the tubular portion 35 is fixedly connected to the lid of the sleeve 3.

After the cardboard package 2 has been clamped from all sides by the ribs and other projections, and a loading has been exerted on the cardboard package, the tips of tubes 61 and 71 can be inserted through the tubular parts 35 and 36 and pressed into the package 2. The package is thereby penetrated without the package yielding and springing back. Therefore, no liquid spurts outwardly through the tubes. The tube 61 of larger diameter is formed at its top as a spout 5, and the tube 71 of smaller diameter serves as a vent.

In the embodiment illustrated in FIG. 6, the projecting portions, i.e. the ribs 12 and 32, are omitted. The same effect is achieved by a sleeve 30 having a cross-sectional shape which is different from the cross-sectional shape of the package 20. The two diagonal dimensions d of the sleeve 30 are smaller than the two diagaonal dimensions D of the package. When the sleeve is fitted over the package, the latter is somewhat compressed diagonally. Since the sidewalls of the sleeve 30 are curved outwardly, the sidewalls of the package can correspondingly spread outwardly. The package is then in a preloaded condition in the sleeve. The insertion of the pouring and ventilation tubes can be effected without causing liquid to spurt out. To increase the preloading, it is advantageous to have the side edges of the sleeve rounded. The curving of the sidewalls preferably begins at the side edges of the sleeve and can amount to over 1 cm.

It is also possible to omit the tube portions 35 and 36 shown in FIG. 1 and to apply the tubes 61 and 71 directly to the sleeve lid. This is preferably effected by a bayonet connection or by an eccentric cam engaging behind the lid, and the tubes can thereby be removed for cleaning. With such an arrangement, the cardboard package 2, 20 is placed in the base portion 1 and the sleeve 3, 30 with the tubes 61, 71 is pushed over the package, the tips of the tubes penetrating the package.

In the first above-described embodiment, the container exerts a pressure on the sidewalls and the bottom of the package, and in the second above-described embodiment the container exerts a pressure on the side edges of the package. When, after emptying of the package, the sleeve of the container is removed from the base portion, the package remains in the sleeve. For removal of the empty package, the sleeve is provided at its lowermost opening with two lateral cutouts which enable trouble-free removal of the package.

The pouring tube and the ventilation tube can be combined in a common lid insert which can be slid into openings in the lid. If different sizes of packages are employed, it is not necessary to replace the whole container. It is sufficient to replace the sleeve. The lid insert is retained.

Protective covers can be fitted on the pouring and ventilation tubes of the container to prevent odours from passing in or out when the filled container is not used.

In the three views shown in FIG. 5, there is illustrated a tube 61 on an enlarged scale. In the vicinity of the inclined tip there is provided a diametrical bridge portion 62 which, when the tube is inserted into the carton, is broken and displaced so that it cannot prevent the discharge of the contents of the container.

On the side of the tube 61 opposite from the inclined side of its tip, there is provided an opening 66. This opening 66 serves to allow even the last drop of liquid to flow from the package.

Despite the preloading of the package, it is possible for a few drops of liquid to flow outwardly adjacent the larger diameter tube 61. This does not, however, constitute a spurting out of the liquid. The tube 71 can therefore be embedded in an absorbent, resilient mass, e.g. of natural rubber, which when the sleeve 3 is empty extends over the tube and, when the sleeve is in use, abuts the package and is displaced backwardly thereby. FIG. 3 shows a sealing and pressure ring 80 extending around the tube portion 38, which ring 80 is urged by a spring 88 or a collapsible bellows against the package for sealing the insertion hole.

The sealing parts 80 and 88 are readily removable so that they can be properly cleaned.

In the elevation and plan views of FIG. 5, another sealing body 81 is shown in broken lines. The sealing body 81 comprises a hollow cylinder having a concave periphery, and is made of resilient material. On insertion of the tube 61 into the package, the sealing body 81 abuts against the package, seals off the hole against lateral discharge of liquid, and is compressed.

The base part 1 has a raised edge 19 which is slightly outwardly curved to provide a funnel-shape, which facilitates the insertion of the sleeve 3. The sleeve 3 itself has, at the lowermost third of its length, a bulge 34 which enables easier fitting of the sleeve over the package and which produces a reduction of the preloading in the lowermost part of the package. The sleeve 3 and the base part 1, which preferably are made of plastics material, can be provided with detents which interengage at opposite sides.

In order that the noses 37 produce sufficient preloading in the package, these noses 37 should be provided at the left and the right of the tube portion 61.

The ribs 32 of the sleeve 3 illustrated in FIGS. 1 and 2 can be arranged near or at the side edges of the sleeves, instead of on the sidewalls, whereby an improved centering and clamping of the package is obtained by this embodiment.

The spout, the tube portions and, in particular, the slide member can be fixedly connected to a hand grip which extends downwardly and laterally of the sleeve 3.

To enable the sleeve 3 to be used for both half liter packages and also for one liter packages, the container can be restricted by an extension cylinder which can be slid between the sleeve 3 and the base part 1 and which has approximately the same cross-section as these two parts.

In the above-described embodiments of the invention, the closure of the package is at its smaller side, i.e. the package is inserted in an upright position into the sleeve. However, packages are now provided which are of low height, but which are wide and long. These can be slid, without modification, into the sleeve in such a way that the closure of the package is at the side. The pouring and ventilation tubes thus penetrate a sidewall of the package. This type of construction is also appropriate when the closure of the package is so thick or extensive that the penetration causes difficulties. In special cases, the sidewalls of the sleeve can be strongly curved so that at least at one side there is provided an oval cross-sectional shape, but the diagonal difference for the edge pressure remains.

The embodiments of the invention in which an exclusive property or privilege is claimed are defined as follows:

1. A serving container for flowable material in package of square edged shape, the container comparising a base portion and sleeve inserted into the base portion and fitted over the package, the sleeve having a lid provided with two tubes of different diameters having inclined tips extending into the interior of the sleeve and for extending into the package and serving as pouring and vent tubes, one of said sleeve and said base portion being provided with means for exerting pressure on the edges of the inserted package, said means for exerting pressure comprising the diagonal dimensions of said sleeve which an smaller than the diagonal dimensions of the package, and a outward curving of the sidewalls of the sleeve and the base portion.

2. A container as claimed in claim 1 wherein the internal side corners of the sleeve are rounded.

3. A container as claimed in claim 1 wherein the means for exerting pressure also comprise ribs projecting towards the interior.

4. A container as claimed in claim 1 where at least one of the tubes is fixed to a disassemblable slide plate which can be secured in an opening in the lid of the sleeve by cams engaging behind the lid.

5. A container as claimed in claim 1, wherein the tube of larger diameter is provided with a bridge portion extending longitudinally from the lid of the tube into the interior of the tube.

6. A container as claimed in claim 1 wherein the tube of larger diameter is provided behind its tip opening and at a side thereof opposite from the bevel with a second opening.

7. A container as claimed in claim 6, wherein the sleeve and the base portion have opposite engaging detents and the free edge of the base portion is funnel-shaped.

* * * * *